United States Patent [19]

Tanaka

[11] 4,201,041

[45] May 6, 1980

[54] DIGITAL ELECTRONIC TIMEPIECE HAVING A TIME CORRECTING MEANS

[75] Inventor: Toyonaru Tanaka, Tokyo, Japan

[73] Assignee: Jeco Company Limited, Kawasaki, Japan

[21] Appl. No.: 822,375

[22] Filed: Aug. 5, 1977

[51] Int. Cl.[2] ..... G04B 27/00

[52] U.S. Cl. ..... 368/85; 368/112; 368/187

[58] Field of Search ..... 58/85.5, 24, 23 R, 74

[56] References Cited

U.S. PATENT DOCUMENTS

| | | | |
|---|---|---|---|
| 3,756,011 | 9/1973 | Nishimura | 58/85.5 |
| 3,795,099 | 3/1974 | Tsuruishi | 58/74 |
| 3,854,277 | 12/1974 | Samejima | 58/74 |
| 3,855,782 | 12/1974 | Nishimura | 58/85.5 |
| 3,889,460 | 6/1975 | Yasukawa | 58/85.5 |
| 3,942,318 | 3/1976 | Fujita | 58/85.5 |
| 3,955,352 | 5/1976 | Berney | 58/85.5 |

*Primary Examiner*—Gene Z. Rubinson
*Assistant Examiner*—Pojunas, Jr. Leonard W.
*Attorney, Agent, or Firm*—Haseltine, Lake & Waters

[57] ABSTRACT

A digital electronic timepiece comprises oscillator means for generating reference clock-pulse signals, a plurality of counter means of successive stages for successively counting the reference clock-pulse signals and respectively producing output signals for displaying numerals at respective digit positions for seconds, tens of seconds, minutes, tens of minutes, hours, and tens of hours, means for digitally displaying time in response to signals for output display of the counter means, and means for supplying a time correction reset signal to the counter means for producing as output signals for display at the digit positions respectively for seconds, tens of seconds, minutes, and tens of minutes. The time correction reset signal resets the counter means for seconds, tens of seconds, minutes, and tens of minutes so that the output signal thereof becomes a signal for "O" display. The counter means for producing an output signal for display at the digit position for tens of minutes operates, when supplied with the reset signal in the time interval from (n−1) hours p minutes to n hours p minutes, to produce as output a signal for causing the counter means for outputting the signal for display at the digit position for hours to produce an output signal for displaying n hours.

3 Claims, 7 Drawing Figures

JECO
H
M
OSC
HR&MIN ADJUST CKT
TIME CORRECT CKT
COUNT
DECOD
DISPLAY
f1, f2
a
b
c
d, d1, d2
e, e1, e2
10
11
12
13
21
22
23
24
25
26
27
28
29
30
31
32
33
34
35
36
37
38
39
40
41
42
43
44
45
46
47
48a
48b

DIGITAL ELECTRONIC TIMEPIECE HAVING A TIME CORRECTING MEANS

BACKGROUND OF THE INVENTION

The present invention relates generally to digital electronic timepieces whose displayed time can be readily corrected (hereinafter referred to as "time adjusted"), and more particularly to a digital electronic timepiece (hereinafter referred to as a digital electronic clock) which, when its displayed time is within a specific "minute" range, can be time corrected with the "hour" display within this "minute" range and, moreover, in such a manner that the "minute" and "second" displays become zero.

The method of time correcting or adjusting a conventional digital electronic clock has comprised, in the case where the displayed time is retarded (slow) relative to the correct time, carrying out fast-forward running to set the display at an advanced time relative to the correct time, temporarily stopping the clock once in this state, and subsequently restarting the clock when the displayed time and the time heard over standard time signal means, such as the telephone, coincide. Another conventional time adjusting method has comprised carrying out fast-forward running and setting the display time at n hr. 00 min. 00 sec., temporarily stopping the clock once in this state, and then restarting the clock when the displayed time and a time signal heard over the television, radio, telephone, or the like coincide.

For carrying out these operations in the time adjusting of a conventional digital electronic clock, it has been disadvantageously necessary to carry out complicated manipulations of switch buttons to place the display in the fast-forward running mode, thereafter to place it in the stop mode, and subsequently to place it in the start mode.

Furthermore, in known electronic wristwatches, in the case when the second display is within a specific second range, there has been a method wherein only the second display is time adjusted as m min. 00 sec. In general, however, in a digital electronic clock in an installation such as that in a motor vehicle, there are cases wherein, because the electrical power source is temporarily cut off at the time of servicing, noise from the outside is caused by occurrences such as sparking, whereby the displayed time becomes greatly incorrect. Consequently, even when the clocking circuit, per se, operates accurately and positively, since the displayed time deviates greatly on the basis of special characteristics due to the installation such as that in a motor vehicle as mentioned above, the time adjustment circuit of a wristwatch, in which circuit time adjustment is carried out with second units, is not applicable.

SUMMARY OF THE INVENTION

Accordingly, it is a general object of the present invention to provide a novel and useful digital electronic clock capable of being time corrected in which the above described difficulties encountered in the prior art have been overcome.

Another object of the invention is to provide a digital electronic clock which, in the case where the displayed time is in the range of from (n−1)hr. p min. to n hr. p min., is capable of being time corrected to n hr. 00 min. 00 sec. In the electronic clock according to the present invention, the time correction can be easily carried out even when the displayed time is greatly in error. This invention is particularly suitable for application to electronic clocks for installation in motor vehicles. Furthermore, even in the case where the displayed time is greatly incorrect, by bringing the displayed time in an approximate manner so that it falls within the above mentioned range, the time correction can be readily carried out, even during driving the motor vehicle, for example, by only manipulating upon hearing an announcement of time of a car radio.

A further object of the invention is to provide a digital electronic clock which, in the case where the displayed time is within the range of from (n−1)hr. 40 min. to n hr. 40 min., or in the case where it is within the range of (n−1)hr. 30 min. to n hr. 30 min., can be time corrected to n hr. 00 min. 00 sec.

Further objects and features of the invention will be apparent from the following detailed description with respect to preferred embodiments of the invention when read in conjunction with the accompanying drawings.

DETAILED DESCRIPTION

Figures 1, 2:
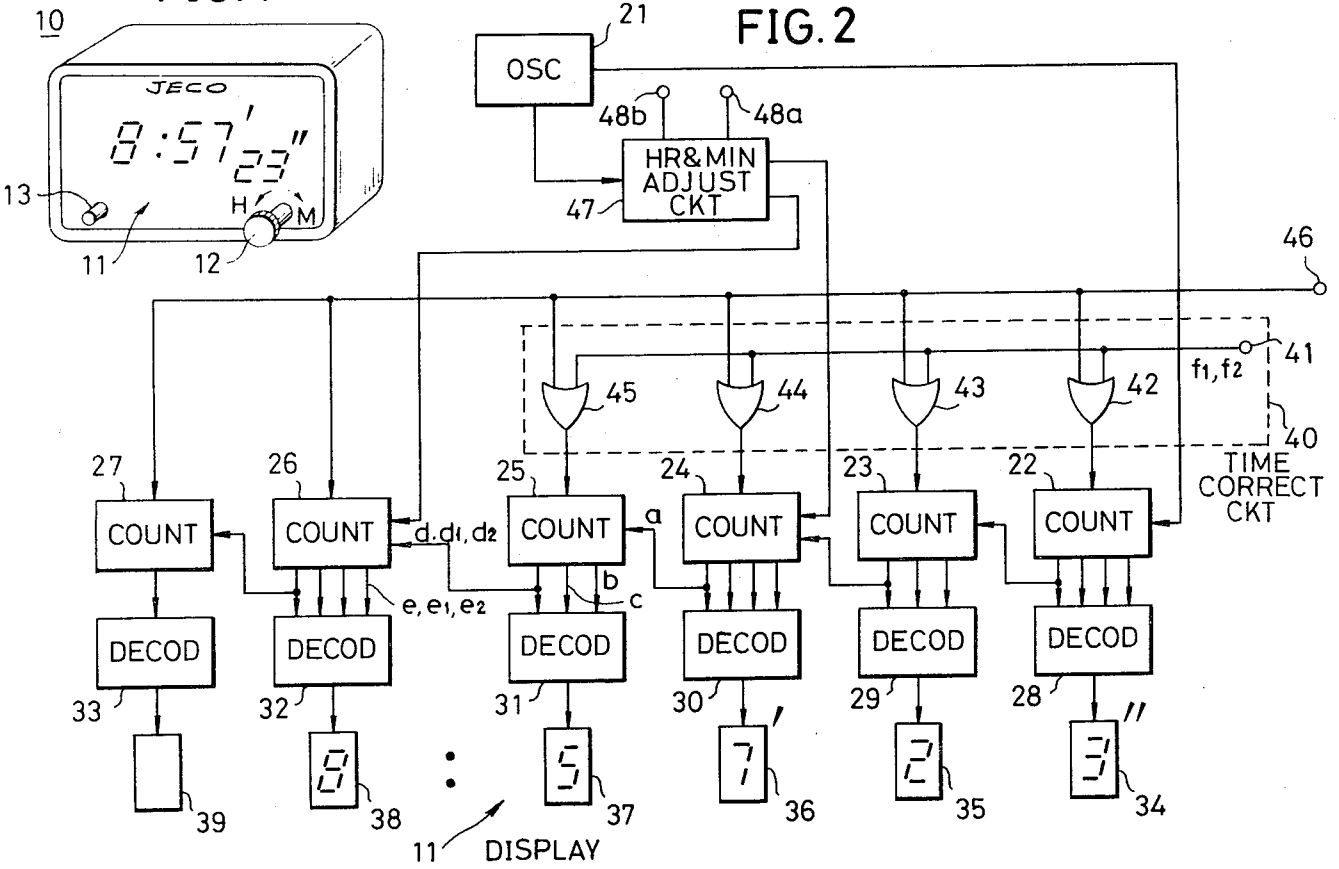
FIG. 1 is a perspective view showing the external appearance of one embodiment of a digital electronic clock according to the present invention.
FIG. 2 is a circuit schematic diagram of a first embodiment of the circuit system of the digital electronic clock according to the invention.

The digital electronic clock 10 according to this invention has a digital time display part 11 and a time correction knob 12 as shown in FIG. 1, for example. By pressing the knob 12 and turning it in the clockwise direction, "minute" correction is carried out; by pressing this knob and turning it in the counter-clockwise direction, "hour" correction is carried out.

By pulling the knob 12, in the case where the displayed time is between (n−1)hr. p min. and n hr. p min., the displayed time is corrected to n hr. 00 min. 00 sec. as described hereinafter. When, in the example of 8 hr. 57 min. 23 sec. illustrated in FIG. 1, the knob 12 is pulled, the displayed time is corrected to 9 hr. 00 min. 00 sec. Furthermore, when a knob 13 is manipulated, the displayed time becomes completely zero. This knob 13 can be used when the clock is to be utilized as a stopwatch.

A first embodiment of the circuit system of the digital electronic clock according to the invention will now be described with reference to FIG. 2. An oscillator circuit 21 for generating clock pulses comprises a crystal oscillator and ½ frequency dividers of, for example, 22 stages. Clock pulses of 1 Hz led out of the frequency divider of the final stage of the oscillator circuit 21 is supplied to a seconds-decimal counter 22. The count output of the counter 22 is supplied by way of a decoder 28 to a display device 34, and the display at a digit position for seconds is accomplished. Each time 10 clock pulses of 1 Hz are supplied to the counter 22, a built-in flip-flop (not shown) operates, and from the counter 22, a carry signal is produced as output every 10 seconds from the counter 22 and is supplied to a tens-of-seconds-base-6 counter 23. The count output of the counter 23 is supplied through a decoder 29 to a display device 35, and the display at a digit position for tens-of-seconds is effected.

Figure 3:
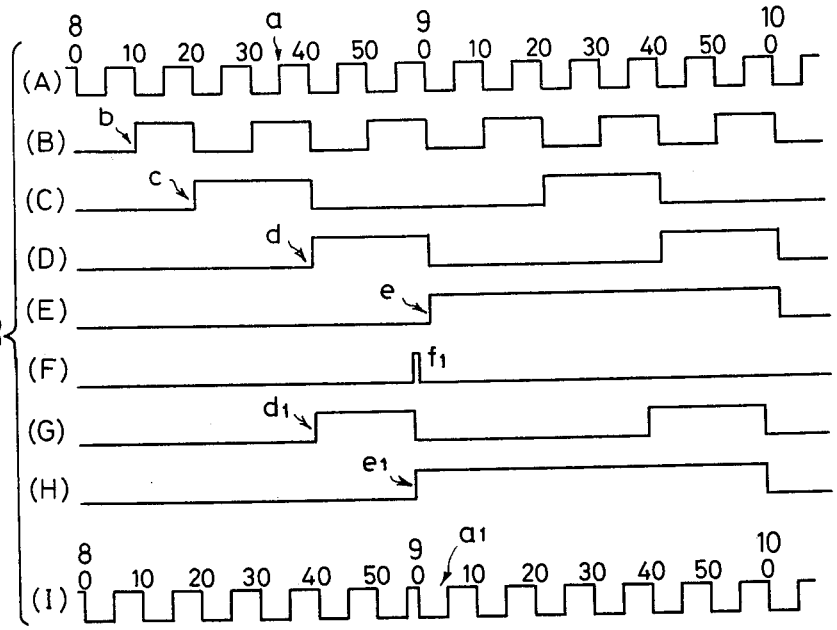
FIGS. 3(A) through 3(I) are signal waveform diagrams respectively for a description of the operation of correcting retarded time of the electronic clock shown in FIG. 2.

A carry signal is produced as output every 60 seconds (1 minute) from the counter 23 and supplied to a minutes-decimal counter 24. The counter 24 counts this signal arriving each minute, and its count output is supplied by way of a decoder 30 to a display device 36, whereupon the display at a digit position for minutes is effected. From the counter 24, a signal a as indicated in FIG. 3(A) having a cyclic period of 10 minutes is supplied to a tens-of-minutes-base-6 counter 25. In response to this signal a, three flip-flops (not shown) built in the counter 25 operate to produce, respectively, output signals b, c, and d of the waveforms indicated respectively in FIGS. 3(B), 3(C), and 3(D). These signals b, c, and d are supplied by way of a decoder 31 to a display device 37, and the display at a digit position for tens-of-minutes is accomplished. Here, the signal b is a signal of a duty ratio of ½ having a cyclic period of 20 minutes. The signal c is a signal which rises at each hour and 20 minutes and falls at each hour and 40 minutes, while the signal d is a signal of a duty ratio of ⅓ which rises each hour and 40 minutes and falls at each hour and 00 minutes (on the hour).

The signal d is supplied as a carry signal to an hours-decimal counter 26. This decimal counter 26 operates from the fall instant of the signal d and produces as output a signal e as shown in FIG. 3(E). This signal e is supplied through a decoder 32 to a display device 38, and the display at the digit position for hours is effected. The output signal of the counter 26 is supplied to a tens-of-hours-binary counter 27 to cause the same to operate. The output signal of this counter 27 is supplied by way of a decoder 33 to a display device 39, and the display at a digit position for tens of hours is effected.

The time correcting operation in the case where the time displayed by the display devices 34 through 39 is retarded (slow) relative to the correct time will now be described.

For illustrative purpose, it will be assumed, for example, that when the correct time is 9 hr. 00 min. 00 sec., the displayed time is 8 hr. 57 min. 23 sec. Upon hearing the time signal for 9 hours over the radio, television, or the like, the operator pulls the knob 12. This manipulation causes a reset signal $f_1$ as indicated in FIG. 3(F) to be introduced through an input terminal 41 of a time correction circuit 40. This reset signal $f_1$ is applied through OR gates 42, 43, 44, and 45 to the counters 22 through 25 respectively. As a consequence, flip-flops in the counters 22 through 25 are reset, and the displays of the display devices 34 through 37 become zero.

During this operation, the output signal d of the counter 25, which is at a high level from 8 hr. 40 min. in the displayed time, assumes a low level at the instant when the reset signal $f_1$ arrives as indicated at $d_1$ in FIG. 3(G). As a consequence, the output signal of the counter 26 assumes a high level at this instant as indicated at $e_1$ in FIG. 3(H). In response to the output signal $e_1$ of the counter 26, the display of the display device 38 is changed from "8" to "9".

Accordingly, when the knob 12 is pulled together with the time signal for 9 o'clock, the display instantaneously changes from "8 hr. 57 min. 23 sec." to "9 hr. 00 min. 00 sec.", time correction being thus carried out. From this instant, the counters 22 through 27 start new counting operations, and the signal fed from the counter 24 to the counter 25 becomes as indicated at $a_1$ in FIG. 3(I).

In a similar manner, when the reset signal $f_1$ is transmitted within the period in which the signal d is at a high level, that is, within the period in which the displayed time is in the interval from the correct time, to which it is to be time adjusted, to the instant 20 minutes before the correct time, time delay correction is carried out similarly as described above.

Next, the time correcting operation in the case where the displayed time is advanced (fast) relative to the correct time will be described.

Figure 4:
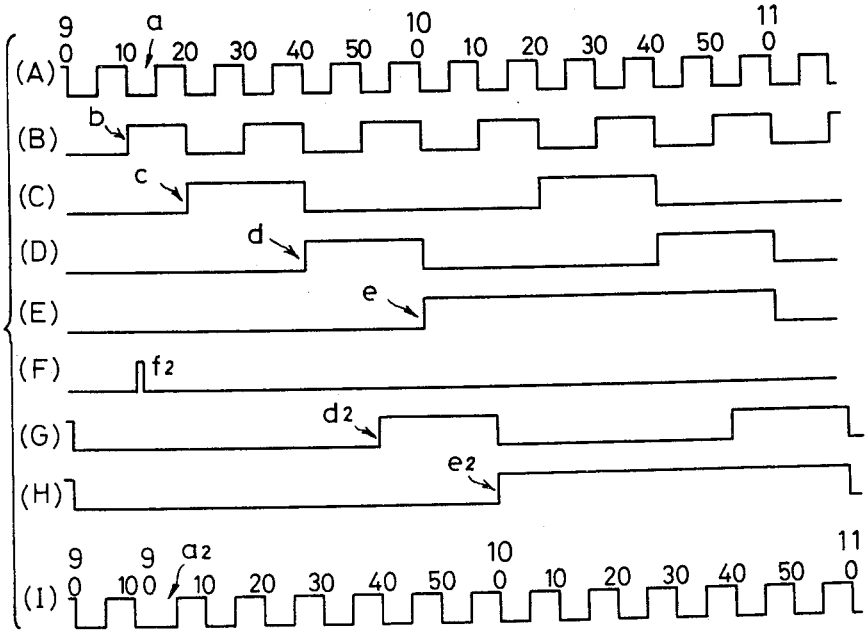
FIGS. 4(A) through 4(I) are signal waveform diagrams respectively for a description of the operation of correcting advanced time of the electronic clock illustrated in FIG. 2.

For illustrative purpose, it will be assumed, for example, that the displayed time is 9 hr. 11 min. 35 sec. when the correct time is 9 hr. 00 min. 00 sec. When the knob 12 is pulled simultaneously with the announcement of the time for 9 o'clock, a reset signal $f_2$ of a waveform as shown in FIG. 4(F) is applied through the input terminal 41 and by way of OR gates 42 through 45 to the counters 22 through 25. The signals a through e shown in FIGS. 4(A) through 4(E) are the same as signals a through e shown in FIGS. 3(A) through 3(E). The flip-flops in the counters 22 through 25 are reset by the reset signal $f_2$, and the displays of the display devices 34 through 37 become "0".

During this operation, the output signal d of the counter 25, which is at a low level from 9 hr. 00 min. in the displayed time, remains at a low level as indicated at $d_2$ in FIG. 4(G). As a consequence, the output signal e of the counter 26 also remains at a low level as indicated at $e_2$ in FIG. 4(H), and the display "9" of the display device 38 also does not change. Therefore, although the displays of the display devices 34 through 37 all become "0" as a result of the application of the reset signal $f_2$, the display of the display device 38 remains "9".

Thus, by pulling the knob 12 with the 9 o'clock time signal, the display is changed from "9 hr. 11 min. 35 sec." to "9 hr. 00 min. 00 sec." thereby to accomplish time correction.

The counters 22 through 27 start new counting operations from this instant, and the signal fed from the counter 24 to the counter 25 becomes as indicated at $a_2$ in FIG. 4(I). The signal $d_2$ becomes of high level after 40 minutes and of low level after 60 minutes from the resetting time. As a consequence, the signal $e_2$ becomes of high level after 60 minutes from the resetting time, and the displayed time becomes "10 hr. 00 min. 00 sec.".

When the reset signal $f_2$ is transmitted within the period in which the signal d is of low level, that is, within the period in which the displayed time is in the interval from the correct time, to which it is to be time corrected, to 40 minutes past, time advance correction is accomplished similarly as described above.

Therefore, according to the embodiment of the present invention, by pulling the knob 12 at the time signal of n hours while the displayed time is in the interval from "(n−1) hr. 40 min. 00 sec." to "n hr. 39 min. 59 sec.", the displayed time is corrected to the correct time "n hr. 00 min. 00 sec.".

In the case where this electronic clock is to be used as a stopwatch, manipulation of the knob 13 causes a reset signal to be introduced through an input terminal 46. This reset signal is applied through OR gates 42 through 25 to counters 22 through 25 and directly to the counters 26 and 27. As a consequence, the displays of the display devices 34 through 39 are all reset to "0". Accordingly, by resetting at a desired instant, the elapsed time from that instant can be read.

Pulses of 2 Hz derived from the frequency divider of the stage preceding the final stage of the oscillator circuit 21 are supplied to an hour and minute adjusting circuit 47. In the case of adjusting only the "minute" display, the knob 12 is pressed and turned clockwise, whereupon the level of a terminal **48*a* varies, whereby pulses of 2 Hz are supplied from the hour and minute adjusting circuit 47 to the counter 24, and the "minute" display is caused to undergo fast forward operation. Furthermore, in the case of adjusting of only the "hour" display, the knob 12 is pressed and turned counterclockwise, whereupon the level of a terminal 48*b* varies, whereby pulses of 2 Hz from the hour and minute adjusting circuit 47 are supplied to the counter 26**, and the "hour" display is caused to undergo fast forward operation.

Figure 5:
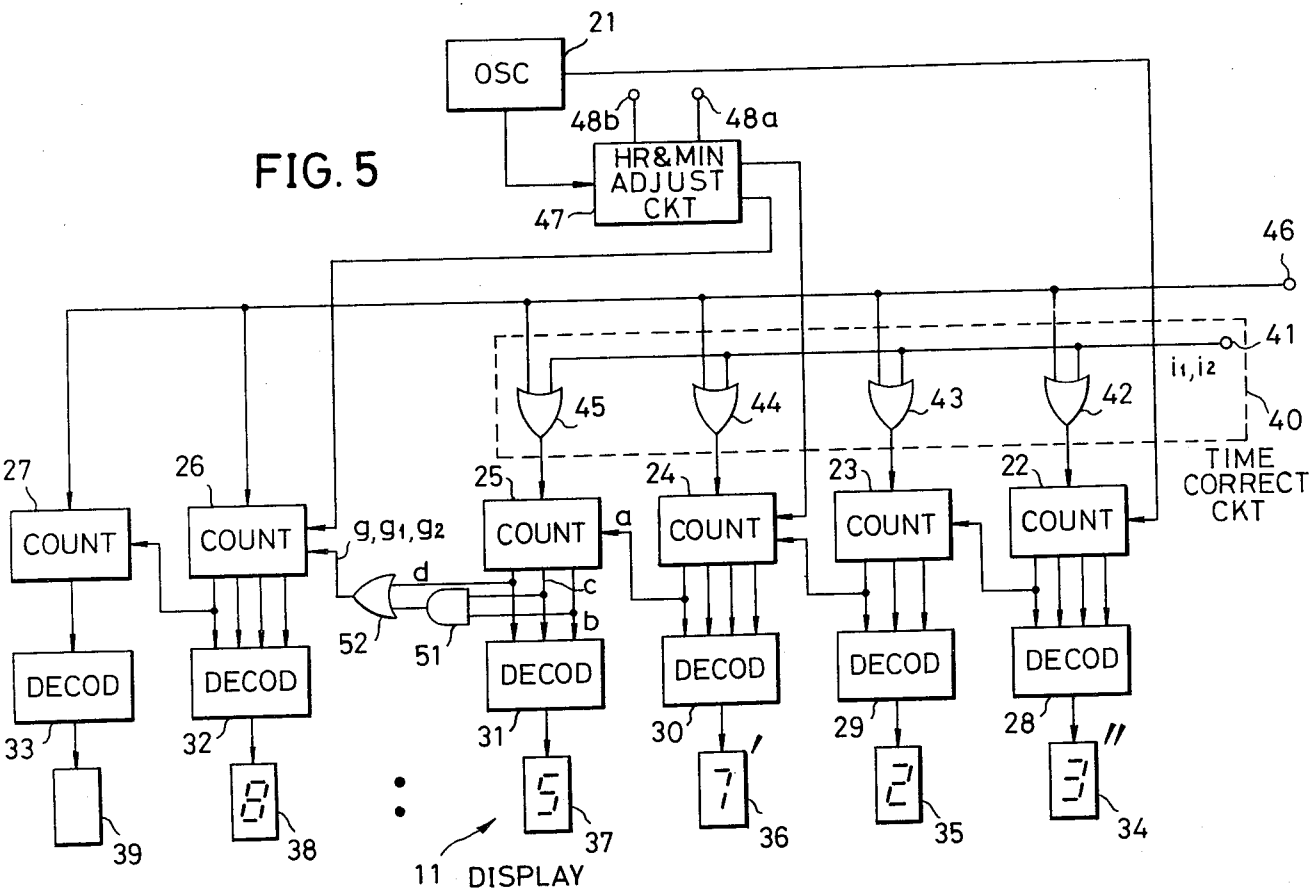
FIG. 5 is a circuit schematic diagram of a second embodiment of the circuit system of the digital electronic clock according to the invention.

A second embodiment of the digital electronic clock of the invention will now be described with reference to FIG. 5. In FIG. 5, those parts which are the same as corresponding parts in FIG. 2 are designated by like reference numerals, and such parts will not be described again in detail.

Figure 6:
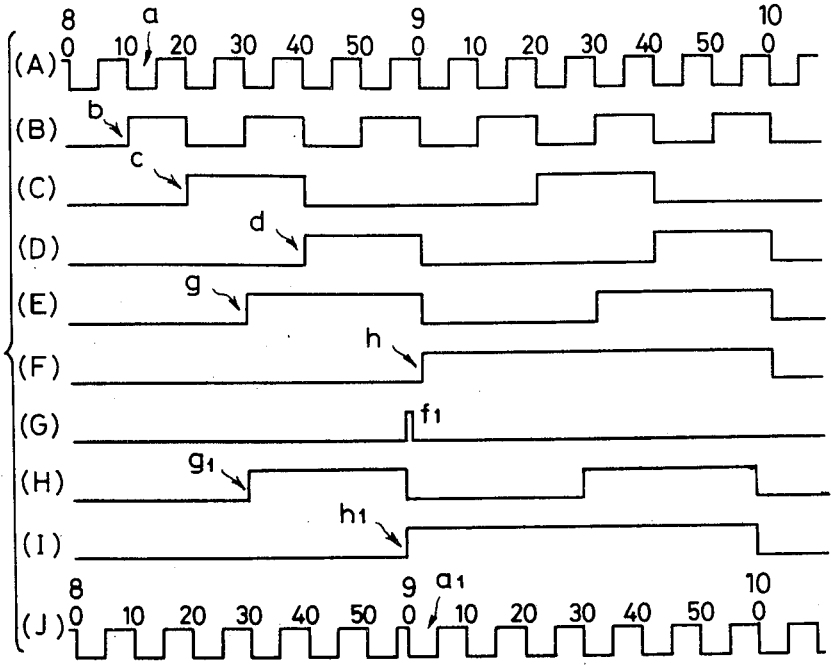
FIGS. 6(A) through 6(J) are signal waveform diagrams respectively for a description of the operation of correcting retarded time of the electronic clock illustrated in FIG. 5.

The output signals b and c of the waveforms shown in FIGS. 6(B) and 6(C) of the tens-of-minutes-base-6 counter 25 are supplied to an AND gate 51, which thereby produces an output signal supplied to an OR gate 52. On one hand, the output signal d of the waveform indicated in FIG. 6(D) of the counter 25 is supplied to the OR gate 52. As a result, a signal g of a duty ratio of ½ as indicated in FIG. 6(E) is derived from the OR gate 52 and supplied to the hours-decimal counter 26. This signal g is a signal becoming of high level after 30 minutes from 0 minute and assuming a low level 60 minutes after. From the counter 26, a signal h which assumes a high level when the signal g assumes a low level is obtained, and at this instant, the display of the display device 38 changes, for example, from "8" to "9".

Then, when the displayed time is retarded (slow), being 8 hr. 57 min. 23 sec., for example, and the knob 12 is pulled at the time signal of 9 hr. 00 min. 00 sec., a reset signal $f_1$ as shown in FIG. 6(G) is applied through the input terminal 41 to the counters 22 through 25. As a consequence, the displays of the display devices 34 through 37 all become "0" similarly as in the preceding embodiment of the invention.

At the same time, at the instant when the reset signal $f_1$ is applied, the output d of the counter changes from high level to low level. For this reason, the output signal of the OR gate also assumes a low level at that instant as indicated at $g_1$ in FIG. 6(H). As a consequence, the output signal of the counter 26 assumes a high level as indicated at $h_1$ in FIG. 6(I), and the display of the display device 38 changes from "8" to "9".

Accordingly, when the knob 12 is pulled at the instant of the time signal of 9 hours, the display changes instantaneously from "8 hr. 57 min. 23 sec." to "9 hr. 00 min. 00 sec.", time correction thus being accomplished. From this instant, the counters 22 through 27 start new counting operations, and the signal supplied from the counter 24 to the counter 25 becomes as indicated at $a_1$ in FIG. 6(J).

When the reset signal $f_1$ is transmitted within the period in which the signal g is at a high level, that is, the period in which the signals b and c are at high levels or the signal d is at a high level, that is, within the period in which the displayed time is in the interval from the correct time to which it is to be time adjusted to 30 minutes before the correct time, correction of retarded time is carried out similarly as described hereinabove.

Figure 7:
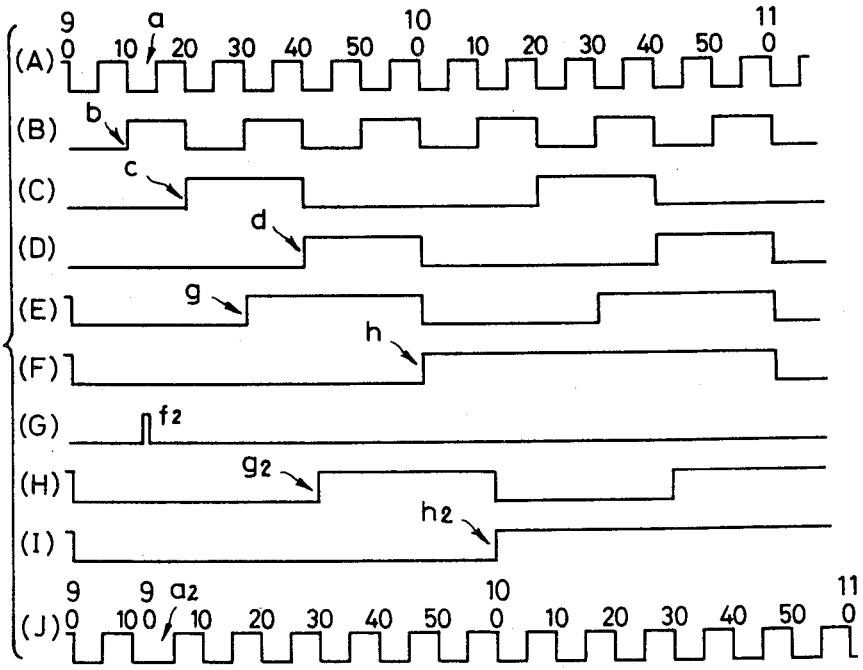
FIGS. 7(A) through 7(J) are signal waveform diagrams respectively for a description of the operation of correcting advanced time of the electronic clock shown in FIG. 5.

Then, when the displayed time is advanced (fast) and is 9 hr. 11 min. 35 sec., for example, and the knob 12 is pulled at the time signal of 9 hours, a reset signal $f_2$ as shown in FIG. 7(G) is applied through the input terminal 41 to the counters 22 through 25. As a consequence, the displays of the display devices 34 through 37 all become "0".

During this operation, the signals b, c, and d have a level relationship wherein the signal g assumes a low level, and even when the signals b or c are caused by the reset signal $f_2$ to assume low levels, the signal g undergoes no variation but remains at the low level. Accordingly, the display of "9" of the display device 38 also does not change.

Therefore, by pulling the knob 12 at the 9 o'clock time signal, the display is corrected from "9 hr. 11 min. 35 sec." to "9 hr. 00 min. 00 sec.". From this instant, the counters 22 through 27 start new counting operations, and the signal supplied from the counter 24 to the counter 25 becomes as indicated at $a_2$ in FIG. 7(J). The output signal of the OR gate 52 assumes a high level 30 minutes after and assumes a low level 60 minutes after the resetting time as indicated at $g_2$ in FIG. 7(H). As a consequence, the signal h assumes a high level 60 minutes after the resetting time as indicated at $h_2$ in FIG. 7(I), and the displayed time becomes "10 hr. 00 min. 00 sec.".

When the reset signal $f_2$ is transmitted within the period in which the signal g is at a low level, that is within the period from the correct time, to which the displayed time is to be time corrected, to 30 minutes past the correct time, correction of advanced (fast) time is accomplished similarly as described hereinbefore.

Therefore, in accordance with the present embodiment of the invention, by pulling the knob 12 at the time signal of n hours with the displayed time in the interval from "(n−1) hr. 30 min. 00 sec." to "n hr. 29 min. 59 sec.", the displayed time is corrected to "n hr. 00 min. 00 sec.".

Further, this invention is not limited to these embodiments but various variations and modifications may be made without departing from the scope and spirit of the invention.

What I claim is:

1. A digital electronic timepiece comprising:

oscillator means for generating reference clock-pulse signals;

a plurality of counter means of successive stages for successively counting the reference clock-pulse signals and respectively producing output signals for displaying numerals at respective digit positions for seconds, tens of seconds, minutes, tens of minutes, hours, and tens of hours, said counter means exclusive of the first-stage counter means being arranged in cascade connection for counting operation initiated by carry signals from the counter means of respectively preceding stages, the counter means for producing an output signal for display at the digit position for tens of minutes supplying as a carry signal a signal of a duty ratio of $\frac{1}{3}$ to the counter means for producing an output signal for display at the digit position for hours;

means for digitally displaying time in response to signals for output display of the counter means; and means for supplying a time correction reset signal to the counter means for producing as output signals for display at the digit positions respectively for seconds, tens of seconds, minutes, and tens of minutes, said time correction reset signal resetting the counter means so that the output signal thereof becomes a signal for "0" display, and said counter means for producing an output signal for display at the digit position for tens of minutes operating, when supplied with said reset signal in the time interval from (n−1) hours 40 minutes to n hours 40 minutes, to produce as output a signal for causing the counter means for outputting the signal for display at the digit position for hours to produce an output signal for displaying n hours.

2. A digital electronic timepiece comprising:

oscillator means for generating reference clock-pulse signals;

a plurality of counter means of successive stages for successively counting the reference clock-pulse signals and respectively producing output signals for displaying numerals at respective digit positions for seconds, tens of seconds, minutes, tens of minutes, hours, and tens of hours, said counter means exclusive of the first-stage counter means being arranged in cascade connection for counting operation initiated by carry signals from the counter means of respectively preceding stages;

circuit means for operating to form a signal of a duty ratio of $\frac{1}{2}$ from the output signal of the counter means for producing an output signal for display at the digit position for tens of minutes and to supply the same as said carry signal to the counter means for producing an output signal for display at the digit position for hours;

means for digitally displaying time in response to signal for output display of the counter means; and means for supplying a time correction reset signal to the counter means for producing as output signals for display at the digit positions respectively for seconds, tens of seconds, minutes, and tens of minutes, said time correction reset signal resetting the counter means so that the output signal thereof becomes a signal for "0" display, and said counter means for producing an output signal for display at the digit position for tens of minutes operating, when supplied with said reset signal in the time interval from (n−1) hours 30 minutes to n hours 30 minutes, to produce as output a signal for causing the counter means for outputting the signal for display at the digit position for hours to produce an output signal for displaying n hours.

3. A digital electronic timepiece as claimed in claim 2 in which the counter means for producing an output signal for display at the digit position for tens of minutes produces as output a first signal of a duty ratio of $\frac{1}{2}$ which repeatedly assumes high and low levels in a 10-minute period, a second signal of a duty ratio of $\frac{1}{3}$ which assumes a high level with the timing with which the first signal assumes the low level and assumes high levels for 20 minutes and low levels for 40 minutes, and a third signal of a duty ratio of $\frac{1}{3}$ which assumes a high level with the timing with which the second signal assumes the low level and assumes a high level for 20 minutes and a low level for 40 minutes; and said circuit means comprises AND gates to which the first and second signals are supplied and OR gates supplied with the resulting output signal of the AND gates and the third signal and producing said carry signal.

* * * * *